US006671978B1

(12) United States Patent
McGowan et al.

(10) Patent No.: US 6,671,978 B1
(45) Date of Patent: Jan. 6, 2004

(54) COMBINATION WASHER/DRYER

(76) Inventors: Ian A. McGowan, 6121 N. 14th St., Arlington, VA (US) 22205-2142; Laura Tartaro-McGowan, 6121 N. 14th St., Arlington, VA (US) 22205-2142

( * ) Notice: Subject to any disclaimer, the term of this patent is extended or adjusted under 35 U.S.C. 154(b) by 0 days.

(21) Appl. No.: 10/292,531

(22) Filed: Nov. 13, 2002

(51) Int. Cl.[7] ..... F26B 11/02

(52) U.S. Cl. ..... 34/596; 34/527; 34/60; D32/5; 68/19.2

(58) Field of Search ..... 34/526, 527, 573, 34/60, 595, 596, 599, 602, 603, 135, 139, 236; D32/5, 6, 8, 11; 68/3 R, 19.2

(56) References Cited

U.S. PATENT DOCUMENTS 3,611,756 A 10/1971 Brucken et al.
4,154,003 A 5/1979 Müller
D288,737 S 3/1987 Deatherage et al.
4,680,948 A 7/1987 Rummel et al.
D298,873 S 12/1988 Erickson et al.
D374,521 S 10/1996 Jackovin et al.
6,481,248 B2 * 11/2002 Willis ..... 68/19.2

FOREIGN PATENT DOCUMENTS

FR 2 701 042 A1 * 8/1994 ..... D06F/58/18

* cited by examiner

*Primary Examiner*—Ira S. Lazarus
*Assistant Examiner*—Andrea M. Ragonese
(74) *Attorney, Agent, or Firm*—Richard C. Litman

(57) ABSTRACT

A combined washer and dryer that automatically moves laundry from the washer to the dryer thereby allowing the operator to avoid manually moving wet laundry and eliminating a step requiring the operator's presence. The invention includes an automatic load-feeder that automatically loads laundry into the washer.

11 Claims, 8 Drawing Sheets

COMBINATION WASHER/DRYER

BACKGROUND OF THE INVENTION

1. Field of the Invention

The present invention relates to household appliances and, more particularly, to a combined washer and dryer that automatically moves laundry from the washer to the dryer thereby allowing the operator to avoid manually moving wet laundry and eliminating a step requiring the operator's presence. The invention includes an automatic load-feeder that automatically loads laundry into the washer.

2. Description of Related Art

Appliances for performing the tasks of washing and drying laundry are well known in the prior art and to the general public. In general, a washer (or washing machine) is used to wash laundry and a dryer is used to dry laundry. Laundry is loaded into a washer which washes the laundry using water and detergent, and then spin-drys the laundry removing most, but not all, of the water. The laundry is then manually moved to a dryer which drys the laundry by applying warm air as the laundry tumbles inside a rotating drum.

The related art teaches combinations in which a washer and dryer are bracketed together, and combinations in which a single drum is used to both wash and dry laundry. Prior art examples of bracketed washer and dryer combinations are provided by U.S. Pat. No. Des. 288,737 to Deatherage et al., U.S. Pat. No. Des. 298,873. to Erickson et al., U.S. Pat. No. Des. 374,521 to Jackovin et al., U.S. Pat. No. 3,611,756 to Brucken, and U.S. Pat. No. 4,680,948 to Rummel et al. The patents to Deatherage, Erickson, Jackovin and Brucken disclose combinations in which a washer and dryer are stacked vertically, with the dryer located above the washer, and the patent to Rummel teaches a mounting bracket assembly that facilitates the mounting of a dryer on top of a washer. The primary benefit of vertically stacked combinations is the reduction in required floor space achieved by moving the dryer above the washer. However, none of the combinations disclosed by these patents allows the operator to avoid manually moving wet laundry from a washer to a dryer, or eliminates a step requiring the operator's presence.

Additionally, U.S. Pat. No. 4,154,003 to Muller provides an example of a combination in which a single drum is used to both wash and dry laundry thereby eliminating the need to manually move wet laundry from a washer to a dryer. However, in such a combination, laundry is dried by recirculating air in the drum through a condenser which removes moisture from the air. This method of drying laundry, as the Muller patent recognizes, requires more drying time than simply discharging the moisture-laden air into the atmosphere as done by dryer-only dryers and, therefore, is a disadvantage.

Thus, none of the above mentioned patents, taken either singly or in combination, is seen to describe the instant invention as claimed.

SUMMARY OF THE INVENTION

The present invention is a combination washer and dryer in which laundry is moved from the washer to the dryer without manual intervention thereby allowing an operator to avoid moving wet laundry and eliminating a step requiring the operator's presence. Additionally, the invention includes an automated load-feeder mounted on top of the washer which automatically drops a load of laundry into the washer.

The load-feeder allows an operator to place one load of laundry in the washer and a second load in the load-feeder. After the first load has been washed and moved to the dryer, the second load is automatically dropped into the washer. The automated load-feeder thereby allows an operator to wash two loads of laundry with just one visit to the laundry room.

Accordingly, it is a principal object of the invention to allow a person to wash and dry a load of laundry without having to move wet laundry from a washer to a dryer.

It is another object of the invention to eliminate a step in the laundry cleaning process that requires a person's presence. By automatically moving laundry from the washer to the dryer, the present invention allows a person to completely wash and dry a load of laundry without having to return to the laundry room and, thereby, allows the person to leave the home during the entire washing and drying process.

It is a further object of the invention to allow a person to wash two loads of laundry with just one visit to the laundry room. With the automated load-feeder, two loads of laundry can be loaded at one time—one inside the washer and one in the load-feeder. After the first load has been washed and dropped into the dryer, the load-feeder drops the second load into the washer which then washes the second load.

Furthermore, it is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
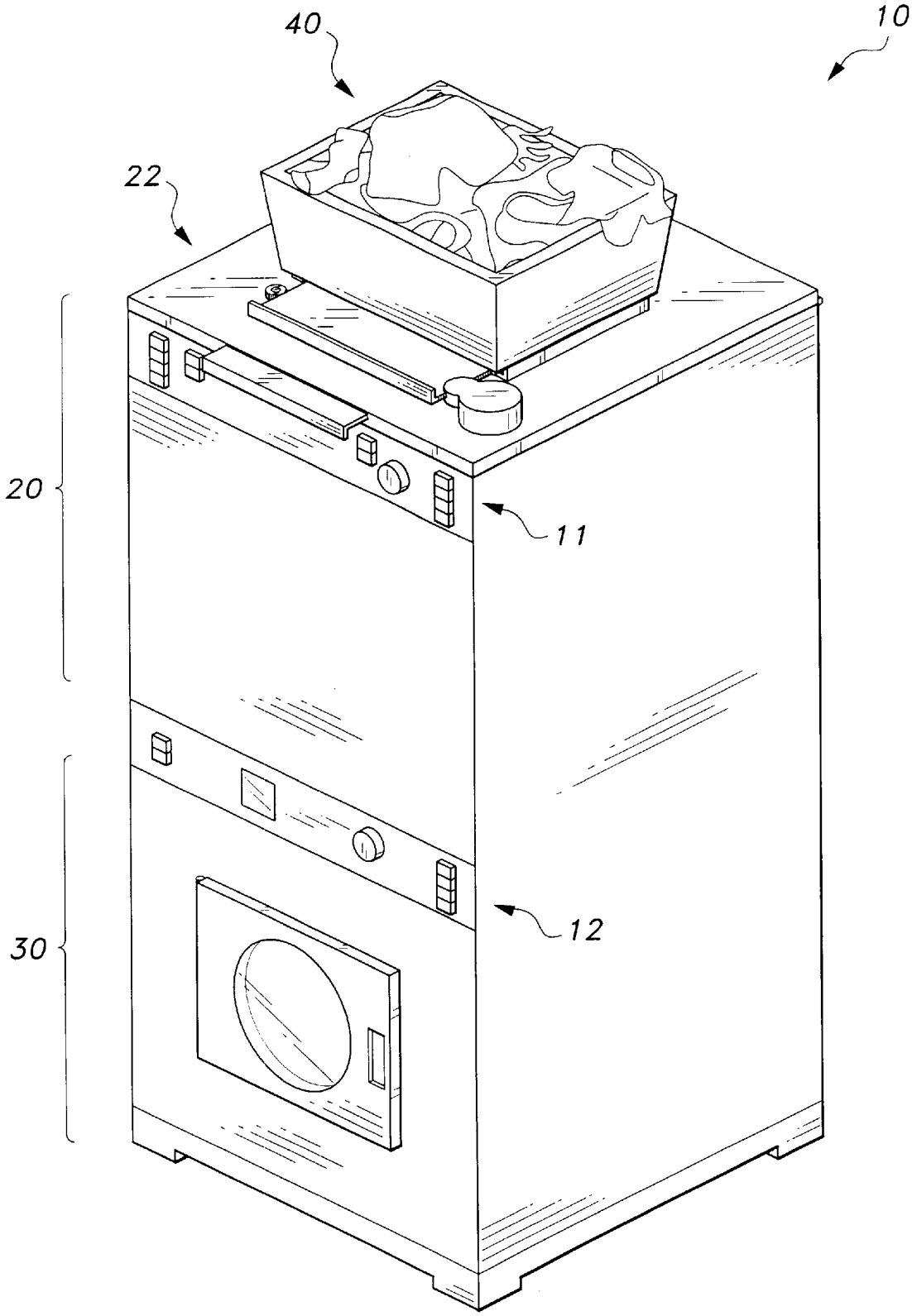
FIG. 1 is an environmental, perspective view of a combination Washer/dryer according to the present invention.

FIG. 1 is a perspective view of a combination washer/dryer 10 according to the present invention. It will be appreciated from the view that the washer 20 and dryer 30 are stacked vertically with the washer 20 on top and that an automatic load-feeder 40 is mounted on top of the washer door 22. It will also be appreciated from the view that two control panels 11 and 12 are located on the front of the device 10. The upper control panel has knobs and buttons 11 that control both-the washer 30 and the load-feeder 40 and, similarly, the lower control 12 panel has controls for the dryer 30.

Figure 2:
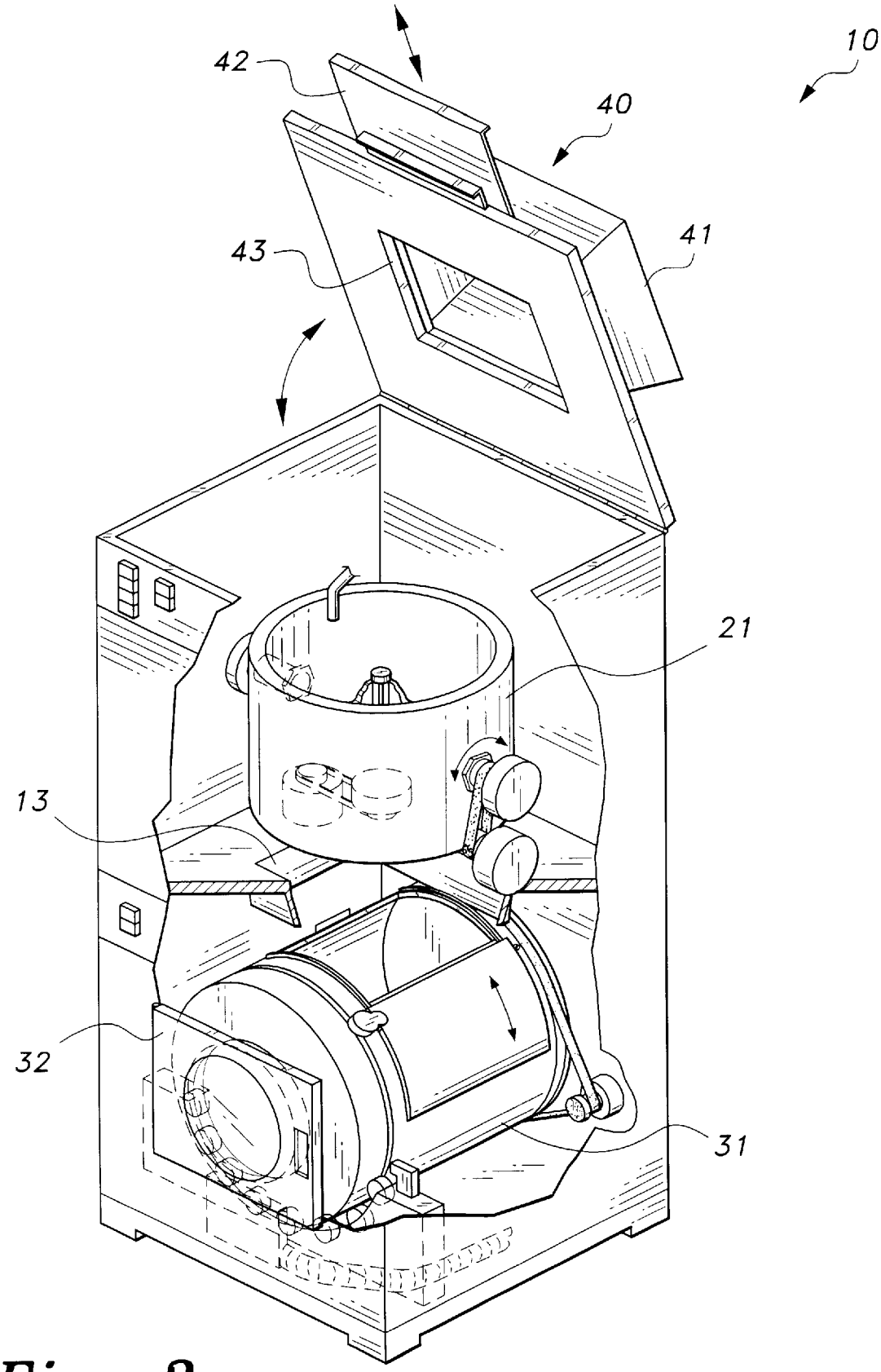
FIG. 2 is a partially cut-away perspective view of the combination washer/dryer shown in FIG. 1.

FIG. 2 shows the washer drum assembly 21 located above the dryer drum assembly, and the load-feeder 40 mounted on top of the washer door 22 (FIG. 1). When the load-feeder door 42 is opened, laundry falls from the hopper 41, through an opening 43 in the washer door 22 and into the washer drum 23. After laundry has been washed, the washer drum 23 is rotated into an inverted position (See FIG. 5) thereby allowing the laundry to fall through a chute 13 and into the dryer drum 31. A gentle shake cycle, in which the washer drum 23 is rotated clockwise and counterclockwise in short alternating intervals, helps laundry drop from the washer drum 23 into the chute 13. The chute 13 is tapered from top to bottom to help guide laundry into the dryer drum 31. Laundry is removed from the dryer through the dryer door 32 which is located on the lower front portion of the device 10.

Figure 3:
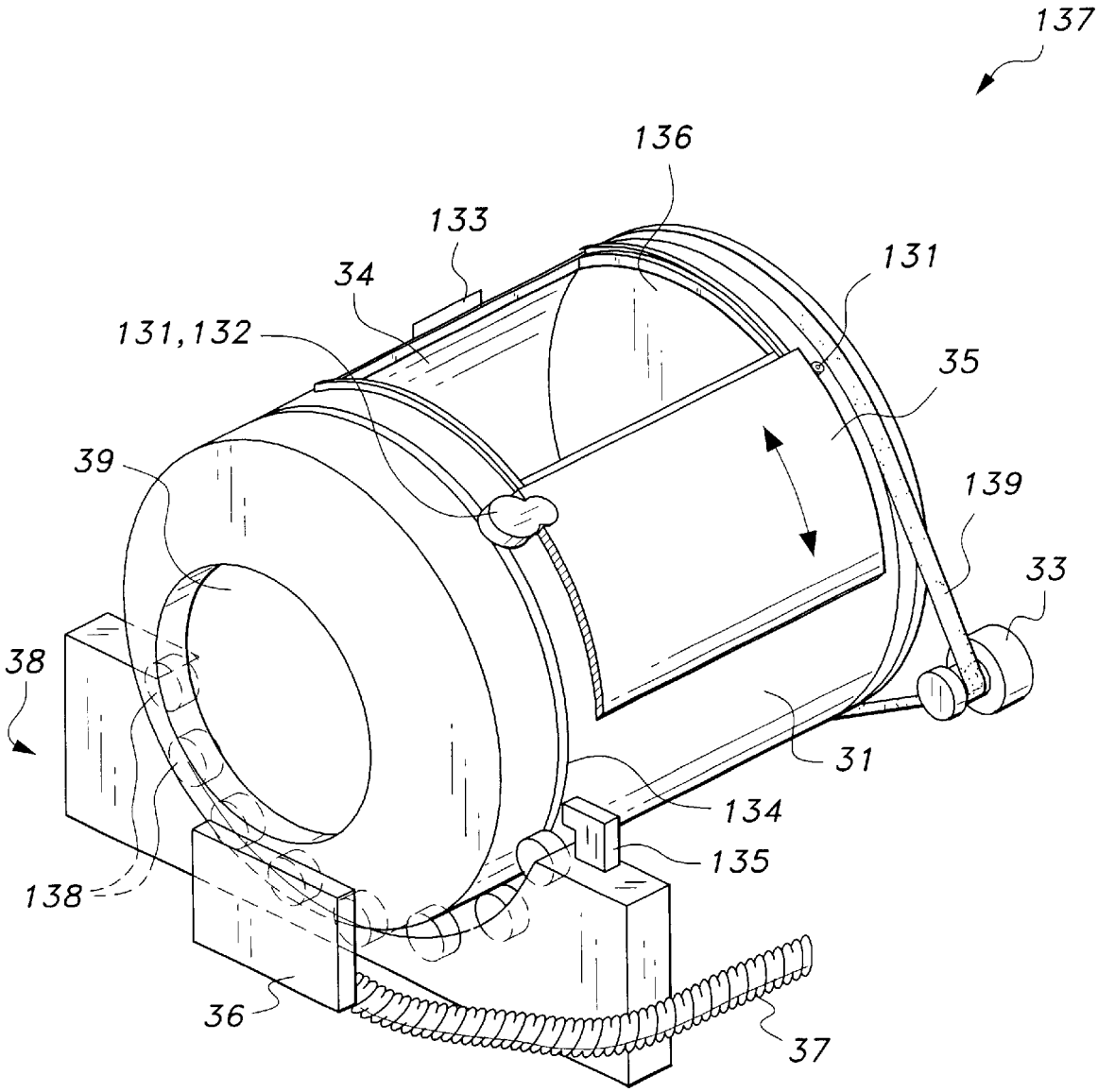
FIG. 3 is a perspective view of the dryer drum assembly.

FIG. 3 illustrates the dryer drum assembly 137. The dryer drum 31 is cylindrical in shape with a rectangular opening 34 on its side. One end of the dryer drum 31 has a round opening 39 through which laundry can be inserted into or remove from the dryer drum 31. The round opening lines up with the dryer door 32 (See FIG. 2). The other end of the dryer drum 31, which is open, mates to an inner wall 136 of the device 10. Warm air is vented into the drum 31 through the wall 136 and moisture-laden air is removed from the drum 31 via a filtered vent 36 located below the dryer door 32 (See FIG. 2). A hose 37 carries the moisture-laden air from the filtered vent 36 to the rear of the device 10.

The dryer drum 31 rests on two bearing blocks 38 each with a plurality of bearings 138. One of the bearing blocks 38 supports the front end of the dryer drum 31 and the other (not shown) supports the rear end. The dryer drum spins freely on the bearings 138 and is rotated by a belt 139 driven by a motor 33 mounted to the frame of the device 10.

To retain laundry in the dryer drum 31 while the dryer drum is rotating, a concave dryer drum door 35 covers the rectangular opening 34. The dryer drum door 35 rotates partially around the drum 32 to uncover the opening 34 and allow laundry to drop into the dryer drum 31 from the washer drum 23. The dryer drum door 35 is mounted on a track and is opened and closed by two gear assemblies 131, one of which is driven by a gear motor 132 mounted on the outside of the dryer drum 31. When the rectangular opening 34 is positioned under the washer drum 23, a retractable electrical contact 135 provides power to the gear motor 132 via a conduit 134.

Figure 4:
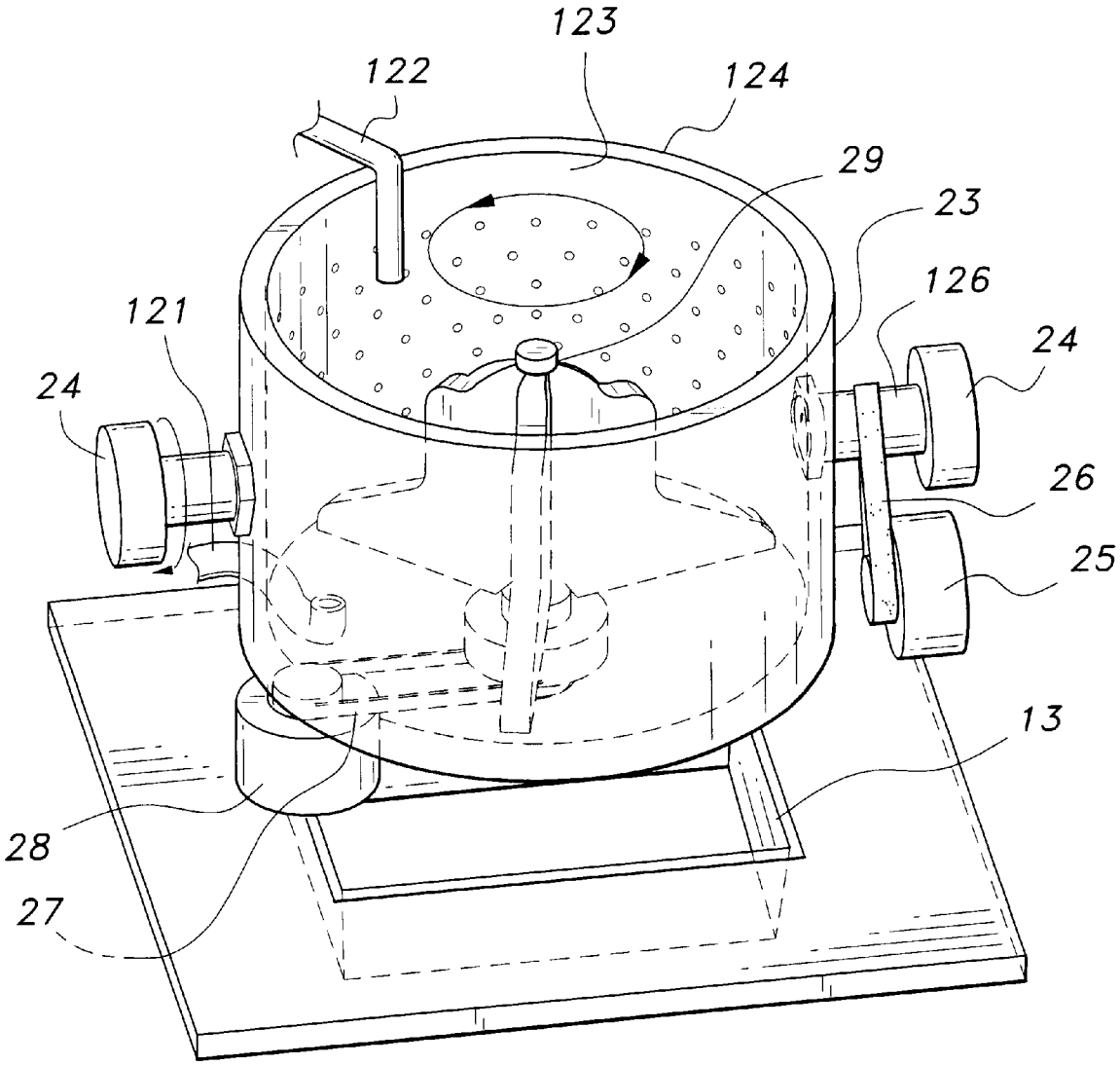
FIG. 4 is a perspective view of the washer drum assembly.

FIG. 4 shows the washer drum assembly 21. The washer drum 23 is cylindrical in shape with a closed bottom and an open top. The drum 23 is comprised of a water-tight outer drum 124 and a perforated inner drum 123. An agitating arm 29 is mounted inside the drum. The agitating arm 29 is rotated clockwise and counter-clockwise by a motor 28 and belt 27 assembly, of which the motor 28 is attached to the bottom of the drum 23. One end of a bearing/axle assembly 24 is attached to opposite sides of the drum. The other end of each bearing/axle assembly 24 is mounted to the frame of the device 10. A belt 26 driven by a motor 25 rotates the axle portion 126 of one of the bearing/axle assemblies 24 thereby inverting the drum 23.

A chute 13 is positioned below the washer drum 23 to guide laundry into the dryer drum as the laundry falls from the washer drum 23. The chute 13 is rectangular in shape with sides that taper inward from top to bottom.

The washer drum 23 has a water supply hose 122 which fills the drum 23 with water, and a drain hose 121 through which water is drained from the drum 23 after each wash or rinse cycle.

Figure 5:
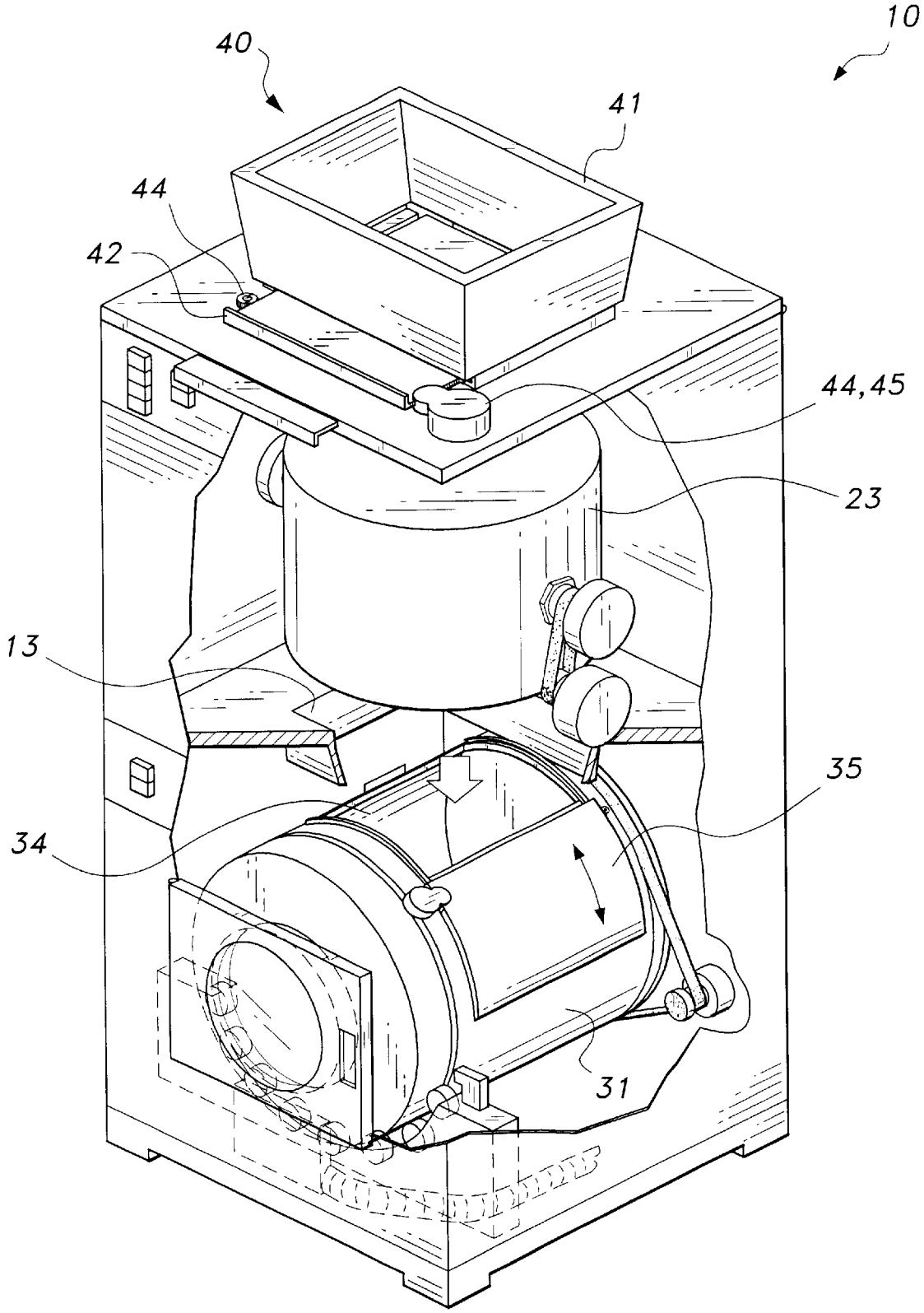
FIG. 5 is a partially cut-away perspective view of the combination washer/dryer showing the washer drum inverted and the dryer drum door open.

FIG. 5 shows the washer drum 23 inverted and the dryer drum door 35 open. When inverted, the washer drum 23 drops washed laundry through the chute 13 and into the dryer drum 31.

To receive laundry from the washer drum 23, the dryer drum 31 is positioned with its opening 34 under the chute 13 and with its door 35 in the open position.

The load-feeder 40 is mounted on top of the washer door 22. The load-feeder door 42 is on a track and is opened and closed by two gear assemblies 44 one of which is driven by motor 45 mounted on the washer door 22. When the load-feeder door 42 is opened laundry drops from the load-feeder hopper 41 through the opening in the washer door 43 and into the washer drum 23 (See FIG. 2).

Figure 6:
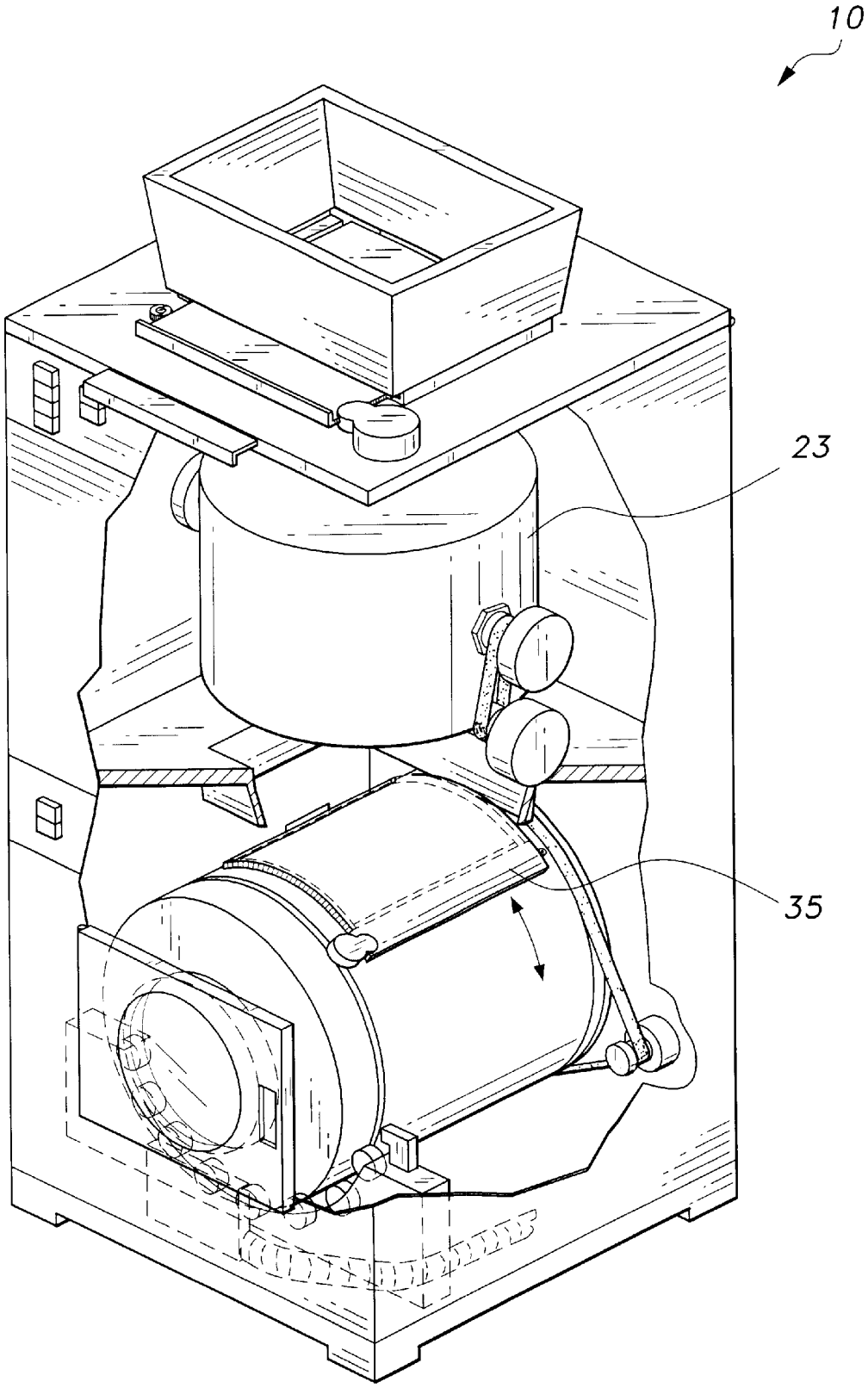
FIG. 6 is a partially cut-away perspective view of the combination washer/dryer showing the washer drum inverted and the dryer drum door closed.

FIG. 6 shows the washer drum 23 inverted and the dryer drum door 35 closed. FIG. 6 is identical to FIG. 5 except that the dryer drum door 35 is closed.

Figure 7:
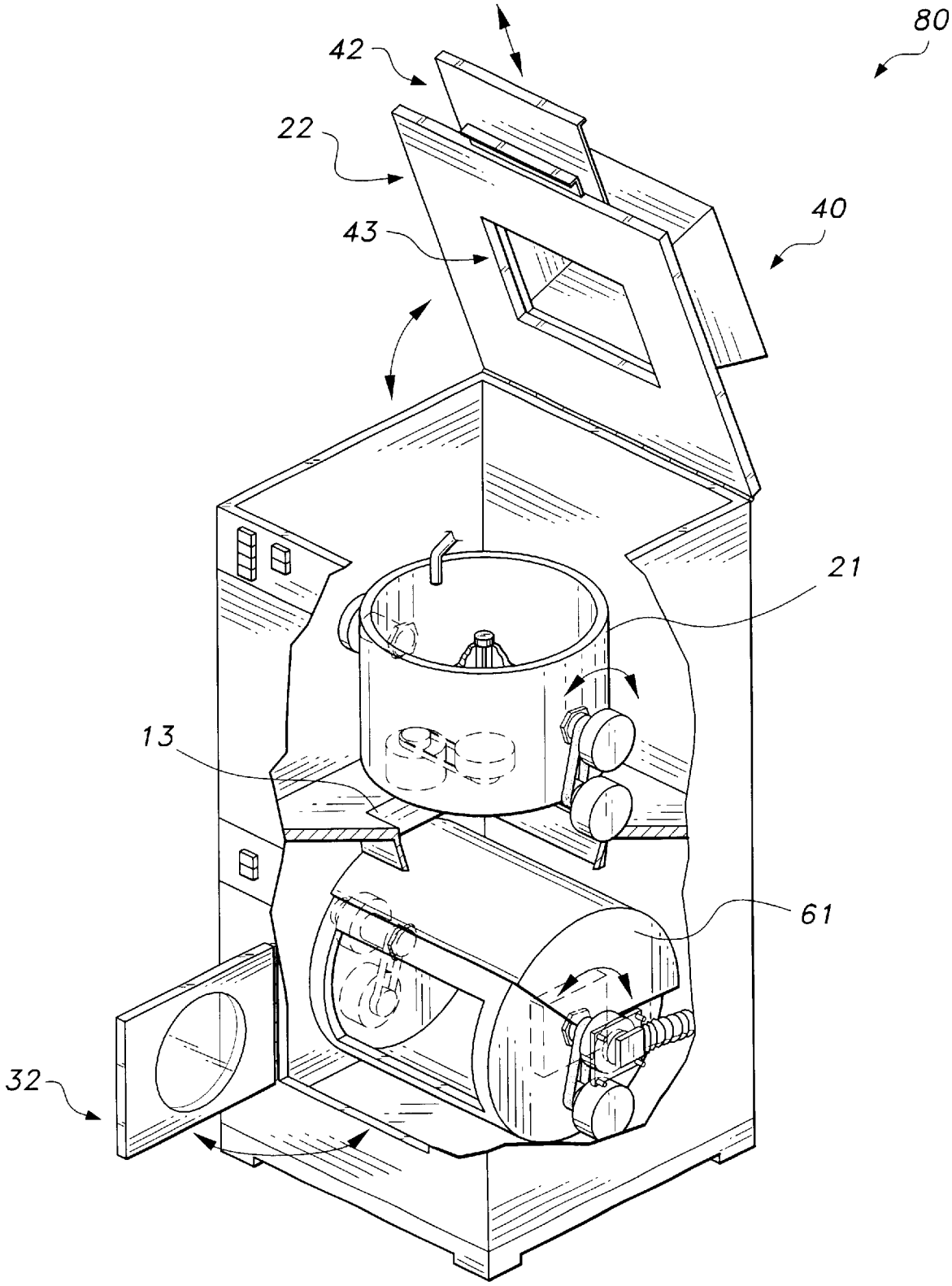
FIG. 7 is a partially cut-away perspective view of an alternative embodiment of a combination washer/dryer.

FIG. 7 depicts an alternative embodiment of a combination washer/dryer. The alternative embodiment 80 differs from the preferred embodiment in that the dryer drum assembly 61, described in detail below, runs from side to side as opposed to front to back.

Figure 8:
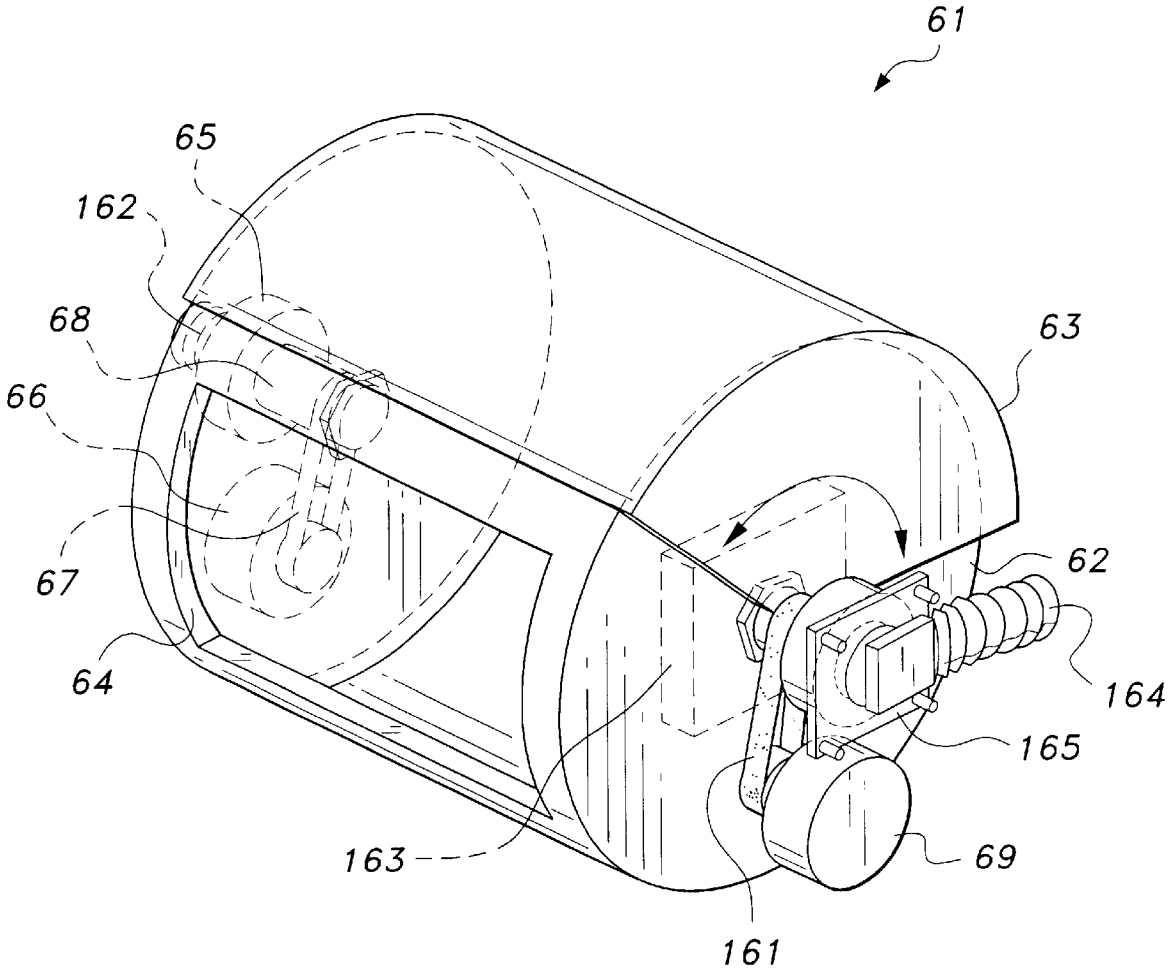
FIG. 8 is a perspective view of an alternative embodiment of t the dryer drum assembly.

FIG. 8 shows an alternative embodiment of the dryer drum assembly 61. The dryer drum 62 is cylindrical in shape with two closed ends and a rectangular opening 64 on its side. One end of a bored bearing/axle assembly 65 is attached to each end of the drum 62 such that the bores open into the dryer drum 62. The other end of each bearing/axle assembly 65 is mounted to the frame of the device 80 via a mounting plate 165 (shown on only one of the bearing/axle assemblies) thereby supporting the drum and allowing it to rotate freely. A belt 67 driven by a motor 66 rotates the axle portion 68 of one of the bearing/axle assemblies 65, thereby rotating the dryer drum 62. The motor 66 is also mounted to the frame of the device 80. Similar to that of a conventional dryer, the dryer drum 62 rotates on a horizontal axis. However, unlike a conventional dryer, the dryer drum 32 rotates from front to back as opposed to side to side.

A concave dryer drum door 63 covers the opening 64 in the drum 62 to retain laundry while drying. The drum door 63 rotates partially around the drum 62 to uncover the opening 64 and allows laundry to be dropped into and removed from the drum 62. The dryer drum door 35 is mounted to the bearing/axles assemblies 65 via sleeves that ride on the axles. A motor 69, mounted on one end of the drum 62, drives a belt 161 that rotates one of the sleeves thereby rotating the sliding door 63 into either an open or closed position.

Warm air is supplied to the dryer drum 62 via a hose 162 attached to the distal opening in one of the bored bearing/axle assemblies 65. Moisture-laden air is removed from the dryer drum 62 via a second hose 164 attached to the distal opening of the other bored bearing/axle assembly. Moisture-laden air passes through an air filter 163 before as it is removed from the dryer drum 62.

It is to be understood that the present invention is not limited to the embodiments described above, but encompasses any and all embodiments within the scope of the following claims.

We claim:

1. A combination washer/dryer comprising: a washer component, a dryer component, and an outer container wherein:

(a) said washer component comprises:

(i) a cylindrical washing drum with an open top and a closed bottom, and including an inner drum and an outer drum, said inner drum sitting inside of said outer drum, said inner drum is perforated and said outer drum is water-tight with a drain hole through its base;

(ii) an agitating arm running through the center of said washing drum, wherein said agitating arm is a shaft with fins protruding outward from its side, a portion of said agitating arm passing through said base of said washing drum, the top of said agitating arm does not extend beyond top end of said washing drum;

(iii) means for rotating said inner drum and said agitating arm;

(iv) means for supplying water to said washing drum;

(v) means for removing water from washing drum through said drain hole;

(vi) means for mounting said washing drum to said outer container means; and (vii) means for inverting said washing drum;

(b) said dryer component comprising:

(i) a cylindrical drying drum rotatably mounted within said outer container means;

(ii) means for rotating said drying drum;

(iii) means for supplying warm air to said drying drum;

(iv) means for removing air from dryer drum; and (v) means for filtering air as it is removed from said dryer drum;

(c) said outer container means encloses said washer component and said dryer component, and comprises:

(i) a rigid frame, (ii) covering which covers said washer component, said dryer component and said frame, (iii) a washer door which provides access through said covering to said washing drum, (iv) a dryer door which provides access through said covering to said drying drum, and (v) two control panels—one for operating said washer component and one for operating said dryer component;

wherein said washer component washes laundry loaded into said washing drum by filling said washing drum with water, agitating water and laundry by rotating said inner drum and said agitating arm, draining water from said washing drum via said drain hole, and rotating said inner drum to drain excess water from laundry via centrifugal force; wherein said dryer component drys laundry loaded in said drying drum by applying warm air to tumbling laundry as said drying drum is rotated, and removing moisture-laden air from said drying drum; and wherein washed laundry is transferred from said washer drum to said dryer drum by inverting said washer drum.

2. The combination washer/dryer according to claim 1, wherein:

said washing drum is mounted to said outer container means via two bearing/axle assemblies attached to opposite sides of said washing drum, said bearing/axle assemblies allowing said washing drum to be rotated into an inverted position, there further being means for rotating one axle of one bearing axle assembly, wherein rotation of said axle causes said washing drum to be inverted;

said drying drum has an opening over which a movable drying drum door is positioned; and means for opening and closing said drying drum door, wherein washed laundry is transferred from washing drum to drying drum upon positioning of said drying drum opening under said washing drum, opening of said drying drum door, rotation of said bearing/axle assembly, inversion of said washing drum and, once laundry is loaded into said dryer drum, closing of said drying drum door.

3. The combination washer/dryer according to claim 2, wherein said outer container means includes a tapered chute between said washer component and said dryer component, wherein said chute tapers inward from top to bottom and wherein, when said washing drum is inverted, laundry falls from said washing drum, through said chute, and into said drying drum.

4. The combination washer/dryer according to claim 2, wherein said means for rotating inner drum can rotate said inner drum clockwise and counter-clockwise in alternating successive intervals of less than five seconds thereby helping free laundry, when washing drum is inverted, from the walls of said inner drum.

5. A load-feeder for a washer comprising:

(a) a laundry hopper having an open top, an open bottom and more than three sides;

(b) a load-feeder door shaped and dimensioned to cover bottom opening of said laundry hopper; and (c) means for opening and closing said load-feeder door;

wherein said load-feeder is mounted on a washer door having an opening that mates to bottom opening of said laundry hopper, said load-feeder door is positioned between bottom opening of said laundry hopper and said opening in said washer door, and wherein when said load-feeder door is in closed position, laundry may be held in laundry hopper, and wherein when said load-feeder door is opened, laundry falls freely through bottom opening of said laundry hopper and through opening in said washer door.

6. The loader-feeder according to claim 5, wherein said sides of said laundry hopper taper inwardly from top to bottom.

7. A combination washer/dryer comprising: a washer component, a dryer component, a load-feeder, and an outer container:

(a) said washer component comprising:

(i) a cylindrical washing drum with an open top and a closed bottom, said washing drum further including an inner drum and an outer drum with said inner drum sitting inside of said outer drum, and wherein said inner drum is perforated and said outer drum is water-tight with a drain hole through its base;

(ii) an agitating arm running through the center of said washing drum, said agitating arm is a shaft with fins protruding outward from its side, a portion of said agitating arm passes through base of said washing drum, and the top of said agitating arm does not extend beyond top end of said washing drum;

(iii) means for rotating said inner drum and said agitating arm;

(iv) means for supplying water to said washing drum;

(v) means for removing water from washing drum through said drain hole;

(vi) means for mounting said washing drum to said outer container; and (vii) means for inverting said washing drum;

(b) said dryer component comprising:

(i) a cylindrical drying drum being rotatably mounted within said outer container;

(ii) means for rotating said drying drum;

(iii) means for supplying warm air to said drying drum;

(iv) means for removing air from dryer drum; and
(v) means for filtering air as it is removed from said dryer drum;

(c) said load-feeder comprising:
(i) a laundry hopper having an open top, an open bottom and more than three sides;
(ii) a load-feeder door shaped and dimensioned to cover bottom opening of said laundry hopper; and
(iii) means for opening and closing said load-feeder door;

(d) said outer container means enclosing said washer component and said dryer component and comprising:
(i) a rigid frame;
(ii) a covering which covers said washer component, said dryer component and said frame,
(iii) a washer door which provides access through said covering to said washing drum,
(iv) a dryer door which provides access through said covering to said drying drum; and
(v) two control panels—one for operating both said washer component and said load-feeder, and one for operating said dryer component;

wherein said load-feeder is mounted on said washer door and said washer door has an opening that mates to bottom opening of said laundry hopper, said load-feeder door is positioned between bottom opening of said laundry hopper and said opening in said washer door, such that when said load-feeder door is in a closed position, laundry may be held in laundry hopper, and when load-feeder door is opened laundry falls freely through bottom opening of said laundry hopper, through opening in said washer door and into said washing drum, wherein said washer component washes laundry loaded into said washing drum by filling said washing drum with water, agitating water and laundry by rotating said inner drum and said agitating arm, draining water from said washing drum via said drain hole, and rotating said inner drum to drain excess water from laundry via centrifugal force, wherein said dryer component drys laundry loaded in said drying drum by applying warm air to tumbling laundry as said drying drum is rotated, and removing moisture-laden air from said drying drum, and wherein washed laundry are transferred from said washer drum to said dryer drum by inverting said washer drum.

8. The combination washer/dryer according to claim 7, wherein: said washing drum is mounted to said outer container means via two bearing/axle assemblies attached to opposite sides of said washing drum, wherein said bearing/axle assemblies allow said washing drum to be rotated into an inverted position, and further including means for rotating one axle of one bearing axle assembly, wherein rotation of said axle causes said washing drum to be inverted, said drying drum having an opening over which a movable drying drum doors is positioned, and means for opening and closing said drying drum door, wherein washed laundry is transferred from washing drum to drying drum upon positioning of said drying drum opening under said washing drum, opening of said drying drum door, rotation of said bearing/axle assembly, inversion of said washing drum and, once laundry is loaded into said drying drum, closing of said drying drum door.

9. The combination washer/dryer according to claim 8, wherein: said outer container means includes a tapered chute between said washer component and said dryer component, wherein said chute tapers inward from top to bottom and wherein, when said washer drum is inverted, laundry falls from said washer drum, through said chute, and into said drying drum.

10. The combination washer/dryer according to claim 8, wherein said means for rotating inner drum can rotate said inner drum clockwise and counter-clockwise in alternating successive intervals of less than five seconds thereby helping free laundry, when washing drum is inverted, from walls of said inner drum.

11. The combination washer/dryer according to claim 8, wherein said sides of said laundry hopper taper inward from top to bottom.

* * * * *